US009429383B2

(12) United States Patent
Martens

(10) Patent No.: US 9,429,383 B2
(45) Date of Patent: Aug. 30, 2016

(54) APPARATUS FOR MOUNTING ACCESSORY TO ARCHERY BOW

(71) Applicant: David Martens, McPherson, KS (US)

(72) Inventor: David Martens, McPherson, KS (US)

( * ) Notice: Subject to any disclaimer, the term of this patent is extended or adjusted under 35 U.S.C. 154(b) by 0 days.

(21) Appl. No.: 14/581,899

(22) Filed: Dec. 23, 2014

(65) Prior Publication Data

US 2015/0184973 A1 Jul. 2, 2015

Related U.S. Application Data

(60) Provisional application No. 61/922,300, filed on Dec. 31, 2013.

(51) Int. Cl.

| | |
|---|---|
| ***F41B 5/20*** | (2006.01) |
| ***F41B 5/00*** | (2006.01) |
| ***F41B 5/14*** | (2006.01) |

(52) U.S. Cl.

CPC ..... *F41B 5/1426* (2013.01); *F41B 5/00* (2013.01); *F41B 5/14* (2013.01)

(58) Field of Classification Search

CPC ..... F41B 5/14; F41B 5/1426; F41B 5/00
USPC ..... 124/86, 88, 89, 23.1; 403/83, 92, 98
See application file for complete search history.

(56) References Cited

U.S. PATENT DOCUMENTS 3,342,172 A * 9/1967 Sanders ..... F41B 5/1426 124/23.1
3,412,725 A * 11/1968 Hoyt, Jr. ..... F41B 5/1426 124/84
3,419,295 A * 12/1968 Small ..... A45B 17/00 135/114
3,589,350 A * 6/1971 Hoyt, Jr. ..... F41B 5/1426 124/89
3,658,157 A * 4/1972 Lee ..... F41B 5/1426 124/89
4,054,121 A * 10/1977 Hoyt, Jr. ..... F41B 5/1426 124/88
4,135,486 A * 1/1979 Enomoto ..... F41B 5/1426 124/89
4,491,123 A * 1/1985 Wirtz ..... B60G 21/0551 124/89
4,553,522 A * 11/1985 Topping ..... F41B 5/1426 124/89
4,877,045 A * 10/1989 Lin ..... A45B 17/00 135/20.3
4,905,946 A * 3/1990 Wang ..... F16M 11/20 248/170
5,239,977 A * 8/1993 Thomas ..... F41B 5/1426 124/88
5,320,085 A * 6/1994 Hanneman ..... F41B 5/1426 124/86

(Continued)

OTHER PUBLICATIONS

Leven Doinker A-Bar Front Mount for A-Bar Stabilizer, BW60138, Oct. 2013.

(Continued)

*Primary Examiner* — Alexander Niconovich
(74) *Attorney, Agent, or Firm* — Jeffrey L. Thompson; Thompson & Thompson, P.A.

(57) ABSTRACT

An apparatus for mounting an accessory, such as a front stabilizer, to an archery bow allows a wide variety of adjusted positions. The apparatus includes first and second coupling members, a first threaded system for securing the first coupling member to a handle of the archery bow, and a second threaded system for securing the first and second coupling members together. The first threaded system allows the first coupling member to be adjusted about its longitudinal axis relative to the bow handle when loosened, and to be fixed relative to the bow handle when tightened. The second threaded system allows the first and second coupling members to be angularly adjusted relative to each other when loosened, and to be fixed relative to each other when tightened. A front stabilizer or other accessory is secured to the second coupling member.

17 Claims, 19 Drawing Sheets

(56) References Cited

U.S. PATENT DOCUMENTS 5,509,400 A * 4/1996 Chalin ..... F41B 5/14 124/86
5,513,622 A * 5/1996 Musacchia, Sr. ..... F16B 7/20 124/86
5,535,731 A * 7/1996 Webster ..... F41B 5/1426 124/89
5,619,981 A * 4/1997 Breedlove ..... F41B 5/1426 124/86
5,630,407 A * 5/1997 Gasser ..... F41B 5/1426 124/89
5,649,527 A * 7/1997 Olsen ..... F41B 5/1488 124/86
5,934,266 A * 8/1999 Martin ..... F41B 5/1426 124/88
5,992,403 A * 11/1999 Slates ..... F41B 5/1426 124/89
6,076,514 A * 6/2000 Adams, Jr. ..... F41B 5/1426 124/89
6,205,992 B1 * 3/2001 Meeks ..... F41B 5/14 124/86
6,216,317 B1 * 4/2001 Chen ..... B25G 1/063 16/430
6,681,755 B2 * 1/2004 Pujos ..... F41B 5/1426 124/89
7,958,881 B2 * 6/2011 Silverson ..... F41B 5/1426 124/86
8,347,870 B1 * 1/2013 Mahutga ..... F41B 5/1426 124/89
8,534,273 B2 * 9/2013 LoRocco ..... F41B 5/1426 124/86
8,701,645 B2 * 4/2014 Stokes ..... F41B 5/1426 124/89
8,839,776 B2 * 9/2014 Kingsbury ..... F41B 5/1426 124/1
8,869,785 B2 * 10/2014 Bidigare ..... F41B 5/1426 124/86
2010/0012107 A1 * 1/2010 Bednar ..... F41B 5/123 124/25
2010/0313864 A1 * 12/2010 Gardner ..... F41A 23/06 124/25.6
2013/0160754 A1 * 6/2013 Dickman, Jr. ..... F41B 5/1426 124/89

OTHER PUBLICATIONS

Doinker Adjustable Offset Mount, BW37169, Oct. 2013.
Doinker Leven Adjustable V-Bar Mount Quick Disconnect, BW37168, Oct. 2013.
Shrewd Fully Adjustable V-Bar w/2 Quick Disconnect Black Double Sided, SHP50791, Oct. 2013.

* cited by examiner

APPARATUS FOR MOUNTING ACCESSORY TO ARCHERY BOW

RELATED APPLICATIONS

This application claims the benefit of U.S. Provisional Patent Application No. 61/922,300 filed on Dec. 31, 2013. The entire content of the priority application is incorporated herein by reference.

BACKGROUND OF THE INVENTION

1. Field of the Invention

The present invention relates generally to archery bows and, in particular, to devices for mounting accessories, such as front stabilizers, to archery bows.

2. Description of the Related Art

An archer's bow must be properly balanced to ensure an accurate shot. If the bow is not properly balanced, the arrow shot will not be true because various forces will cause the bow to pull to one side or another, or cause the bow to lift up or pull down. All this, can affect the accuracy of the archer's shot.

Typically, an archer will add or mount various items to the bow. Such items include, for example, bow sights, arrow quivers, and stabilizers. These items change the balance of the bow, and may affect the accuracy of the archer's shot. To counteract the weight of the attachments to the bow and to increase stability during shooting, one or more stabilizers with a counter-balancing weight can be attached to the bow.

Stabilizers generally comprise a mass that is capable of moving to reduce noise and vibration that occurs upon release of the bow string. The movement of the mass is typically opposed by a spring means and/or a viscous damping force. The stabilizer typically has a threaded end screwed to the front side of a bow riser, and extends in approximately the same direction as that in which an arrow is propelled from the bow.

Additional rear mounted stabilizers are sometimes attached to the bow to extend in a rearward direction to provide additional counter-balancing and stabilizing for the bow. An example of a bow equipped with both a front stabilizer and a pair of rear stabilizers is disclosed in U.S. Pat. No. 5,630,407 (Gasser).

U.S. Pat. No. 4,491,123 (Wirtz), U.S. Pat. No. 5,239,977 (Thomas) and U.S. Pat. No. 5,619,981 (Breedlove) disclose elbow assemblies used to allow a front-mounted stabilizer to pivot away from its normal position to reduce snagging in the field and to provide a more compact arrangement when transporting the bow. These elbow assemblies also allow the stabilizer to be selectively locked into its normal forward extending position. However, conventional elbow assemblies do not allow the stabilizer to be positioned at any desired angle (up and down, and side to side) to accurately balance the bow.

There is a need for an improved device for mounting accessories, such as stabilizers, to archery bows to provide a better range of adjustment to more accurately balance and stabilize the bow.

SUMMARY OF THE INVENTION

An object of the present invention is to provide an apparatus for mounting accessories to an archery bow that allows the accessories to be positioned at a wide variety of orientations for balancing the bow.

A further object of the present invention is to provide an apparatus that can be used for mounting both front stabilizers and rear stabilizers on an archery bow.

A further object of the present invention is to provide an apparatus for mounting accessories to an archery bow that provides a secure and stable adjustable mounting, that can be adjusted through a wide range of positions and orientations, that is efficient to manufacture, that is simple to use, and that is capable of a long and reliable operating life.

To accomplish these and other objects of the present invention, an apparatus is provided for mounting an accessory, such as a front stabilizer, to an archery bow. The apparatus includes first and second coupling members, a first threaded system for securing the first coupling member to a front side of a handle of the archery bow, and a second threaded system for securing the first and second coupling members together. The first threaded system allows the first coupling member to be adjusted about its longitudinal axis relative to the bow handle when loosened, and to be fixed relative to the bow handle when tightened. The second threaded system allows the first and second coupling members to be angularly adjusted relative to each other when loosened, and to be fixed relative to each other when tightened. A front stabilizer or other accessory is secured to the second coupling member in front of the bow handle. The apparatus allows a wide variety of adjusted positions for the mounted accessory. The apparatus can also be used to mount a rearwardly extending accessory to the bow, such a rear stabilizer.

According to one aspect of the present invention an apparatus for mounting an accessory to an archery bow is provided, comprising: a first coupling member having a first longitudinal axis; a first threaded system for securing the first coupling member to a handle of an archery bow, the first threaded system being arranged to allow the first coupling member to be adjusted about the first longitudinal axis when loosened, and to fix the first coupling member against rotation about the first longitudinal axis when tightened; a second coupling member having a second longitudinal axis; a second threaded system for securing the first and second coupling members together, the second threaded system being arranged to allow the first and second coupling members to be adjusted about an axis perpendicular to the first and second longitudinal axes when loosened, and to fix the first and second coupling members together when tightened; and a means for securing an accessory to the second coupling member.

According to another aspect of the present invention, an adjustable stabilizer assembly for an archery bow is provided, comprising: a first coupling member having a first longitudinal axis; a first threaded system for securing the first coupling member to a handle of an archery bow, the first threaded system being arranged to allow the first coupling member to be adjusted about the first longitudinal axis when loosened, and to fix the first coupling member against rotation about the first longitudinal axis when tightened; a second coupling member having a second longitudinal axis; a second threaded system for securing the first and second coupling members together, the second threaded system being arranged to allow the first and second coupling members to be adjusted about an axis perpendicular to the first and second longitudinal axes when loosened, and to fix the first and second coupling members together when tightened; and an elongated stabilizer secured to the second coupling member and extending along the second longitudinal axis.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

Figure 1:
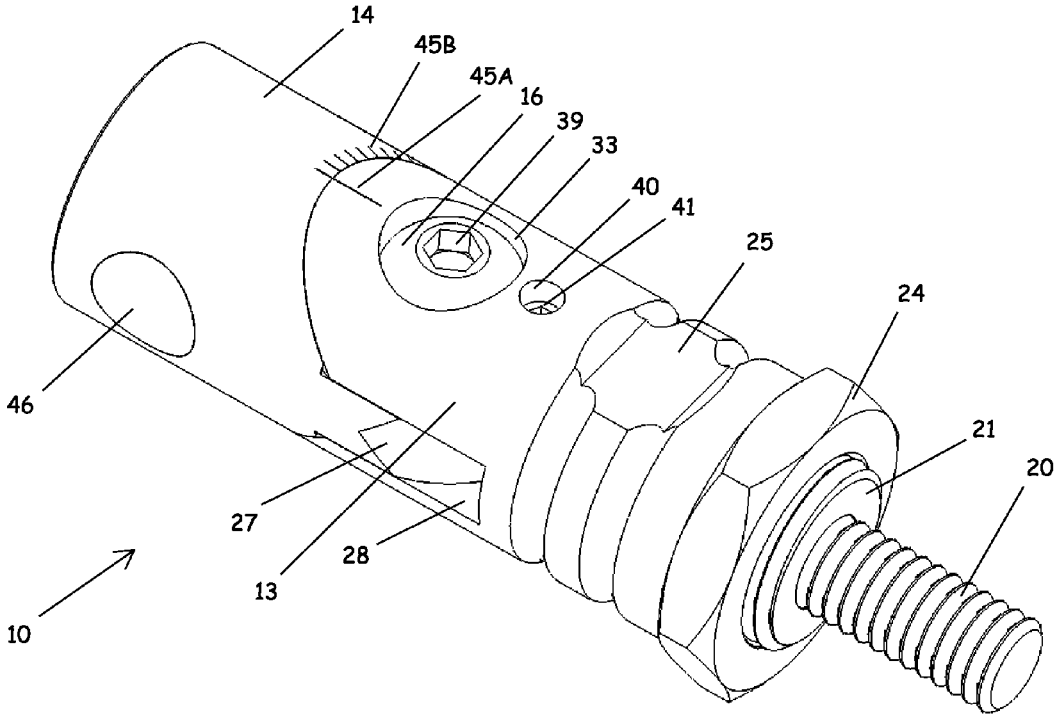
FIG. 1 is a perspective view of an apparatus for mounting an accessory to an archery bow according to the present invention.
Figure 2:
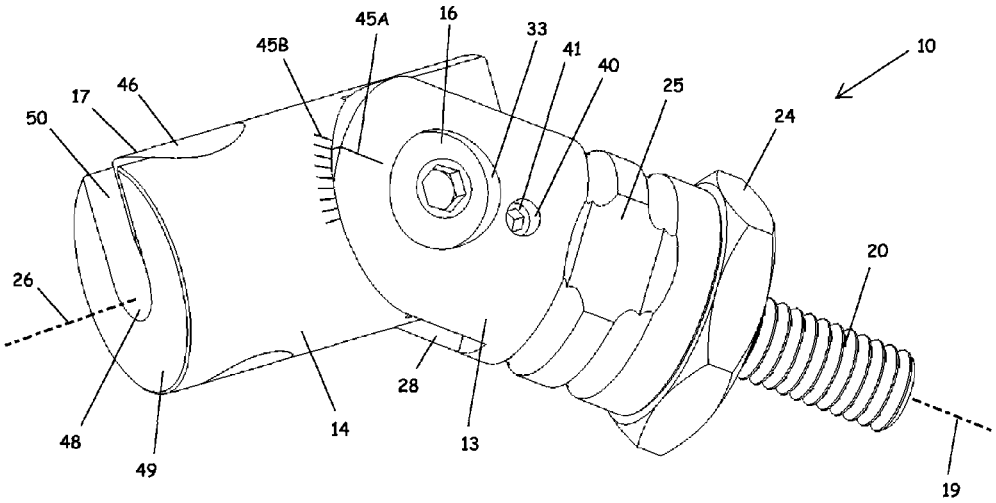
FIG. 2 is a perspective view of the apparatus in an angled position.
Figure 3:
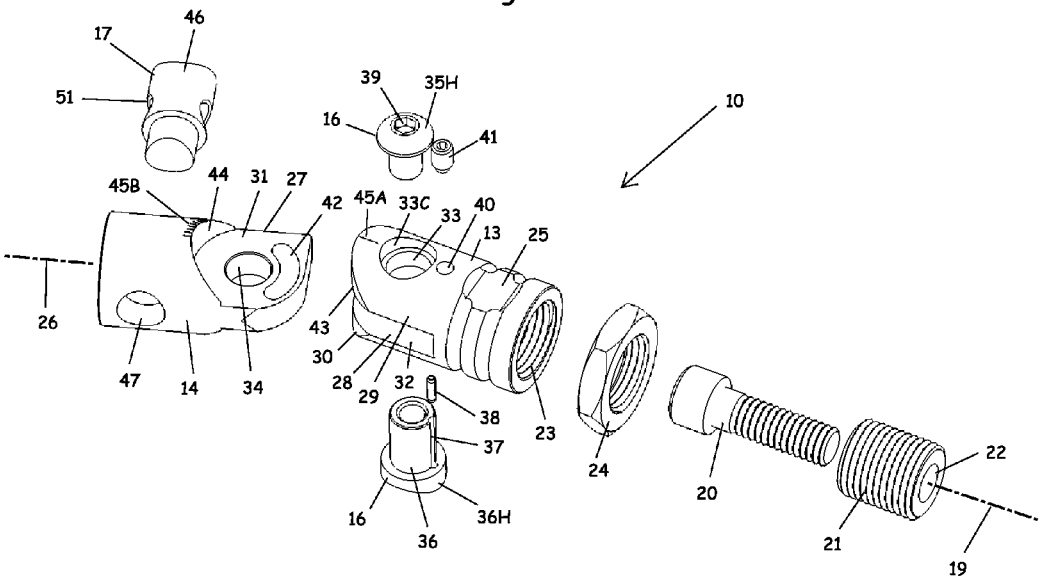
FIG. 3 is an exploded perspective view of the apparatus.

An apparatus 10 for mounting an accessory, such as a front stabilizer 11, to an archery bow 12 will be described in detail with reference to FIGS. 1 to 19 of the accompanying drawings.

The apparatus 10 includes a first coupling member 13, a second coupling member 14, a first threaded system 15, a second threaded system 16, and a quick-disconnect coupling 17. The first threaded system 15 is for securing the first coupling member 13 to a handle 18 of an archery bow 12. The second threaded system 16 is for securing the first and second coupling members 13, 14 together. The quick-disconnect coupling 17 is for securing an accessory, such as a front stabilizer 11, to the apparatus 10.

The first coupling member 13 has a first longitudinal axis 19. The first threaded system 15 is arranged to allow the first coupling member 13 to be rotatably adjusted about the first longitudinal axis 19 when loosened, and to fix the first coupling member 13 against rotation about the first longitudinal axis 19 when tightened.

The first threaded system 15 includes a threaded bolt 20 that mates with a female threaded receptacle in the front side of the bow handle 18. The threaded bolt 20 is rotatable about the first longitudinal axis 19. The first threaded system 15 also includes a threaded stud 21 having a longitudinal bore 22. The threaded bolt 20 extends through the longitudinal bore 22 in the stud 21 to fix the stud 21 to the bow handle 18.

The first coupling member 13 has a female threaded receptacle 23 at one end mated with the threaded stud 21. A jam nut 24 is threaded onto the threaded stud 21. The jam nut 24 is arranged to fix the first coupling member 13 against rotation relative to the threaded stud 21 when the jam nut 24 is tightened against the first coupling member 13. The first coupling member 13 has a pair of diametrically opposed flat portions 25 formed on an external surface thereof for allowing a wrench to be used to hold the first coupling member 13 in a desired position while tightening the jam nut 24.

The second coupling member 14 has a second longitudinal axis 26. The second threaded system 16 is arranged to allow the first and second coupling members 13, 14 to be rotatably adjusted about an axis perpendicular to the first and second longitudinal axes 19, 26 when loosened, and to fix the first and second coupling members 13, 14 together when tightened.

The first and second coupling members 13, 14 are mated together by a projection 27 extending from one end of the second coupling member 14 that fits into a slot 28 formed between two side portions 29, 30 on the first coupling member 13. The side portions 29, 30 are integral with the first coupling member 13, and the projection 27 is integral with the second coupling member 14. Alternatively, the projection 27 can be provided on the first coupling member and the slot provided on the second coupling member.

The projection 27 has flat left and right side surfaces 31 that are parallel with each other. The side portions 29, 30 have flat facing surfaces 32 that are parallel with each other and arranged to engage the side surfaces 31 of the projection 27 when the first and second coupling members 13, 14 are coupled together.

A first lateral bore 33 extends through the side portions 29, 30 perpendicular to and intersecting with the first longitudinal axis 19 of the first coupling member 13. A second lateral bore 34 extends through the projection 27 perpendicular to and intersecting with the second longitudinal axis 26 of the second coupling member 14. The first and second lateral bores 33, 34 are aligned when the first and second coupling members 13, 14 are mated together.

The second threaded system 16 extends through the aligned bores 33, 34 of the first and second coupling members 13, 14. The second threaded system 16 is arranged to cause the two side portions 29, 30 to squeeze against the projection 27 to fix the first and second coupling members 13, 14 against rotation relative to each other when tightened.

The second threaded system 16 includes a male threaded member 35 and a female threaded member 36. The threaded members 35, 36 are inserted into the aligned bores 33, 34 from opposite sides of the first coupling member 13. Each of the male and female threaded members 35, 36 has an enlarged head portion 35H, 36H. The outer portions 33C of the bore 33 through the side portions 29, 30 of the first coupling member 13 are countersunk to allow the heads 35H, 36H of the threaded members 35, 36 to be contained within respective outer profiles of the side portions 29, 30.

The female threaded member 36 is keyed to prevent rotation relative to the first coupling member 13. A first key way 37 is formed in an outer surface of the female threaded member 36, a second key way is formed in an inner surface of the bore 33 of the first coupling member 13, and a key 38 is fit into the first and second key ways to maintain the female threaded member 36 in a fixed angular position relative to the first coupling member 13. Alternatively, other rotation preventing structures can be used instead of the cooperating key 38 and key ways 37 shown in the drawings. For example, the female threaded member 36 can be provided with one or more flat surfaces that mate with one or more corresponding flat surfaces on the inner surface of the bore 33 to prevent rotation of the female threaded member 36 relative to the first coupling member 13.

The head 36H of the female threaded member 36 has a curved shape that matches the outer profile of the side portion 30 in which the female threaded member 36 is inserted when the female threaded member 36 is in its fixed angular position relative to the first coupling member 13.

The head 35H of the male threaded member 35 has a hex-shaped receptacle 39 for receiving an allen wrench or other suitable wrench for turning the male threaded member 35 for selectively tightening and loosening the second threaded system 16.

A threaded set screw bore 40 is formed through at least one of the side portions 29 of the first coupling member 13. A set screw 41 is threaded into the set screw bore 40 and arranged to engage against a portion of the projection 27 of the second coupling member 14 to lock the coupling members 13, 14 against rotation relative to each other when tightened. An arcuate groove 42 is formed in the projection 27 for receiving the engaging end of the set screw 41. The set screw 41 provides a secondary means for locking the first and second coupling members 13, 14 together. Although only one set screw bore 40, set screw 41 and arcuate groove 42 are illustrated in the drawings, it should be understood that a second set screw bore and set screw can be provided through the side portion 29, or through the other side portion 30, to provide an additional means for locking the first and second coupling members 13, 14 together.

The distal ends 43 of the side members 29, 30 of the first coupling member 13 are arcuate and convex. A base 44 on each side of the projection 27 on the second coupling member 14 is arcuate and concave. The convex shape of the ends 43 of the side members 29, 30 corresponds with the concave shape of the base 44 on each side of the projection 27. Adjacent outer surfaces of the first and second coupling members 13, 14 are maintained in close proximity with each other when the first and second coupling members 13, 14 are adjusted relative to each other.

Indicia 45A, 45B are provided on the adjacent outer surfaces of the first and second coupling members 13, 14 for providing a visual indication of an angle of adjustment between the first and second coupling members 13, 14. The indicia 45A, 45B are provided adjacent to the arcuate ends 43 of the side members 29, 30 and the arcuate base 44 on each side of the projection 27.

The quick-disconnect coupling 17 comprises an inset member 46 that fits into a laterally extending bore 47 on the second coupling member 14. A longitudinally extending bore 48 extends through a distal end 49 of the second coupling member 14 and has an open slot 50 between the longitudinal bore 48 and the lateral bore 47. The inset member 46 has a threaded receptacle 51 that can be aligned with the longitudinal bore 48 for receiving a threaded member protruding from an accessory, such as a stabilizer 11.

The accessory 11 is secured to the second coupling member 14 by first loosely threading the threaded member of the accessory 11 into the threaded receptacle 51 of the inset member 46. The inset member 46 is then inserted into the lateral bore 47 until the threaded member of the accessory 11 is aligned with the longitudinal axis 26 of the second coupling member. 14 The accessory 11 is then tightened relative to the second coupling member 14 by rotating the accessory 11 to cause the threaded connection between the accessory 11 and the inset member 46 to become tight. The accessory 11 can be quickly disconnected by merely loosening the threaded connection between the inset member 46 and the accessory 11 and moving the accessory 11 laterally relative to the second coupling member 14.

Figure 18:
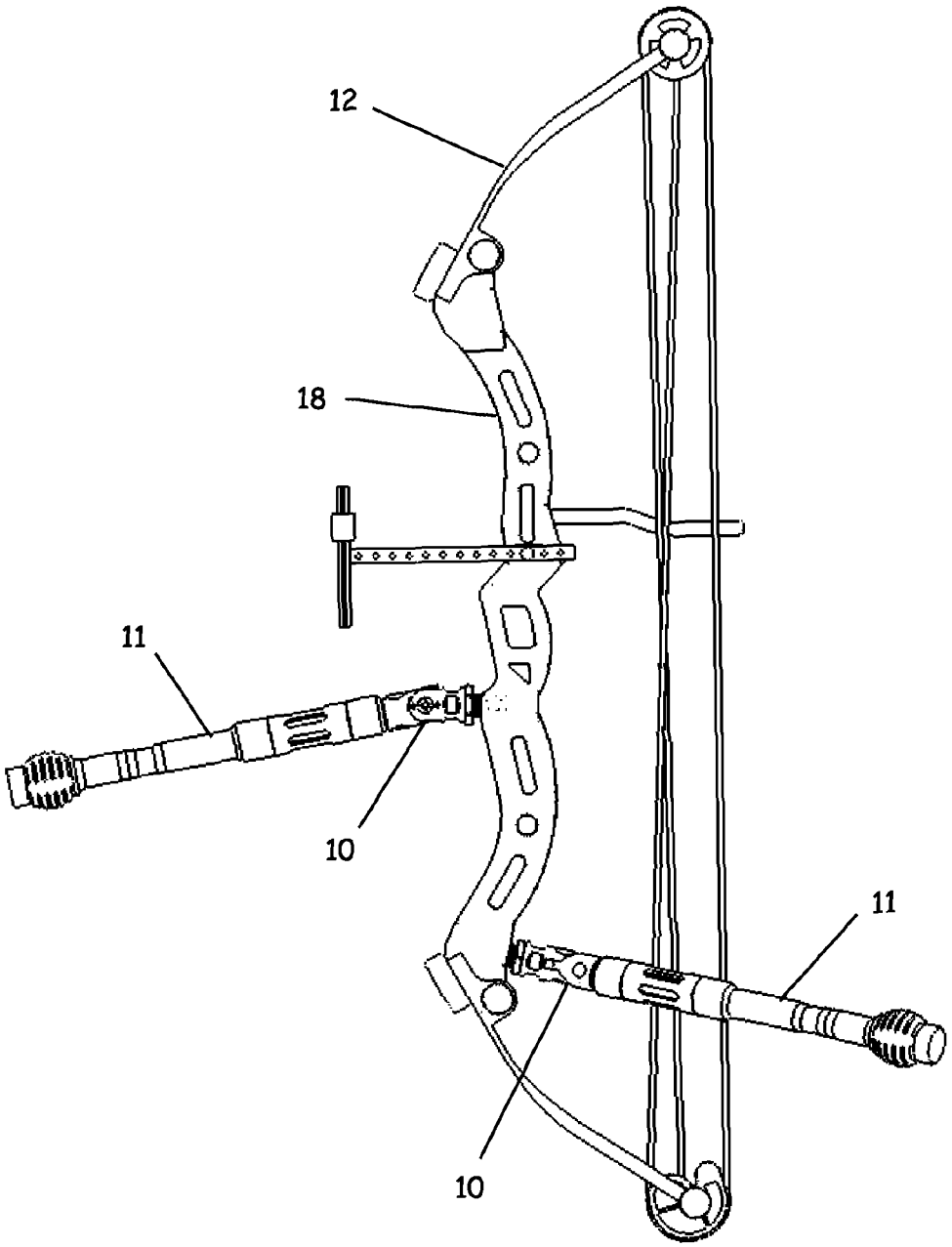
FIG. 18 is a side elevation view of an archery bow with a front stabilizer and a rear stabilizer both mounted to the bow using the apparatus of the present invention.
Figure 19:
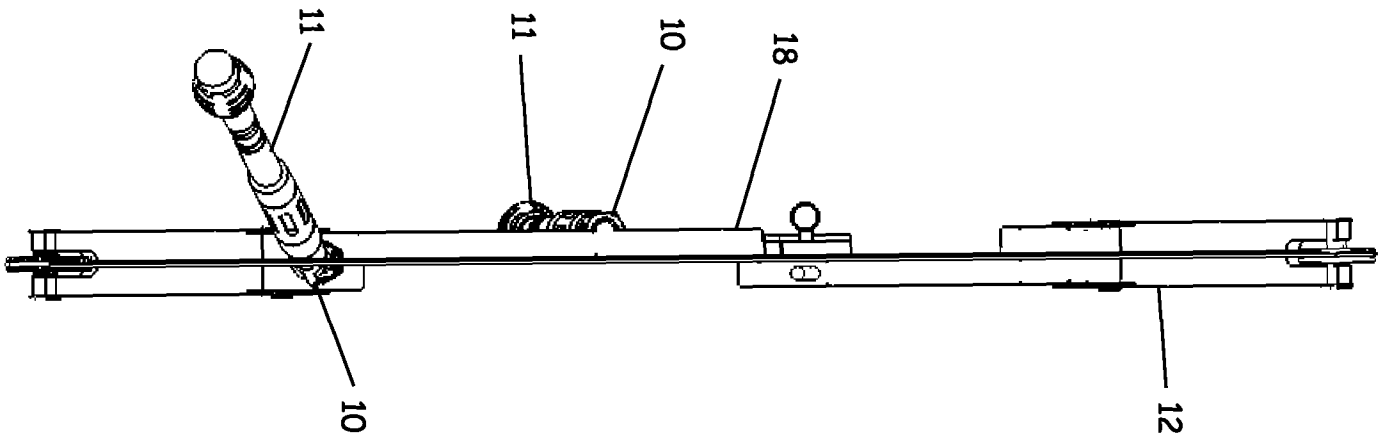
FIG. 19 is a rear elevation view of the archery bow shown in FIG. 18 with the front and rear stabilizers mounted using the apparatus of the present invention.

FIGS. 4 to 17 show how the mounting apparatus 10 can be used to mount a front stabilizer 11 to an archery bow 12. FIGS. 18 and 19 show how the mounting apparatus 10 can be used to mount both front and rear stabilizers to an archery bow 12. The archery bow 12 includes a bow handle 18 having a threaded bore in a front side thereof. The stabilizer 11 is an elongated member for stabilizing the bow 12. The stabilizer 11 has a threaded member protruding from one end. The threaded member of the stabilizer 11 is connected to the mounting apparatus 10 using the quick-disconnect coupling 17 described above.

Figure 4:
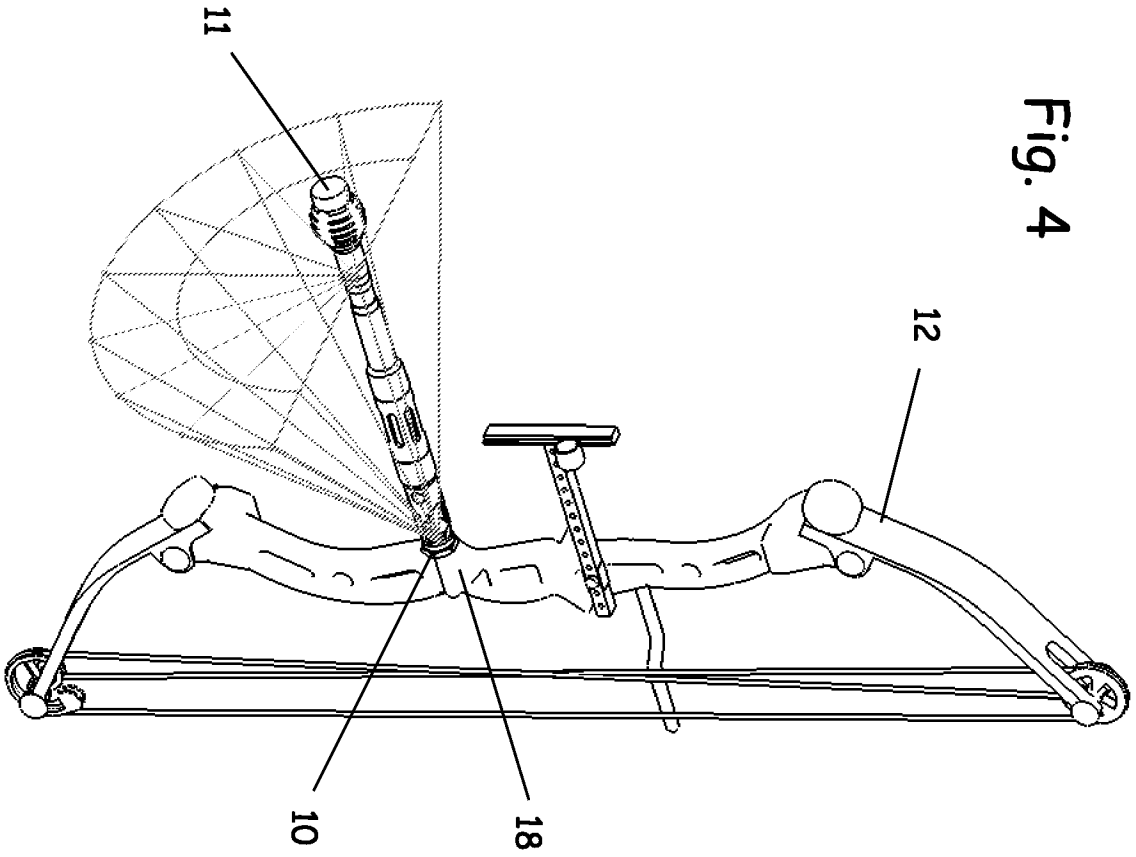
FIG. 4 is a perspective view of an archery bow having a stabilizer mounted to the bow using the apparatus shown in FIG. 1, with phantom lines indicating various positions of adjustment of the stabilizer.
Figure 5:
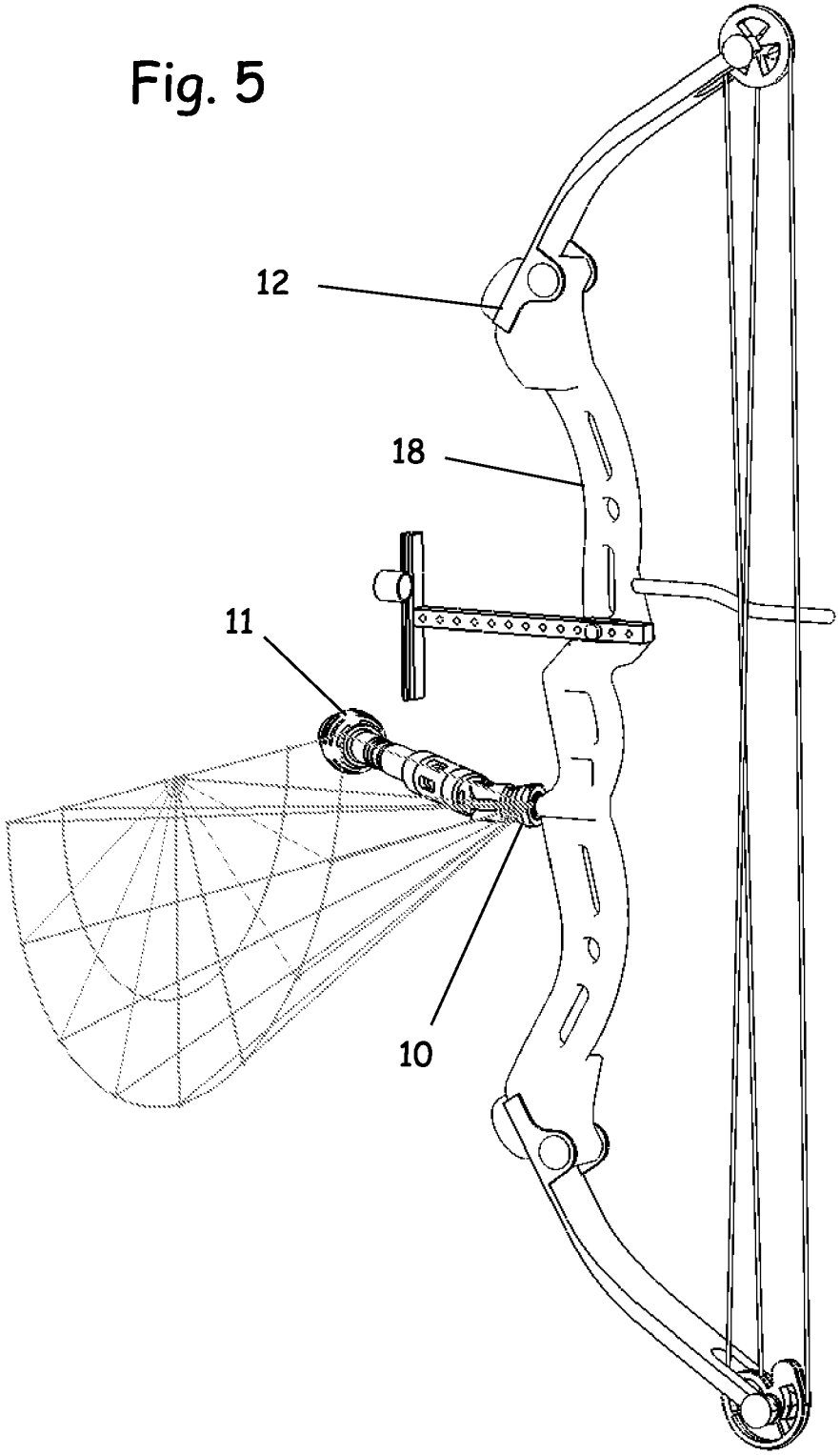
FIG. 5 is another perspective view of the archery bow with the stabilizer mounted using the apparatus, with phantom lines indicating the various positions of adjustment of the stabilizer.
Figure 6:
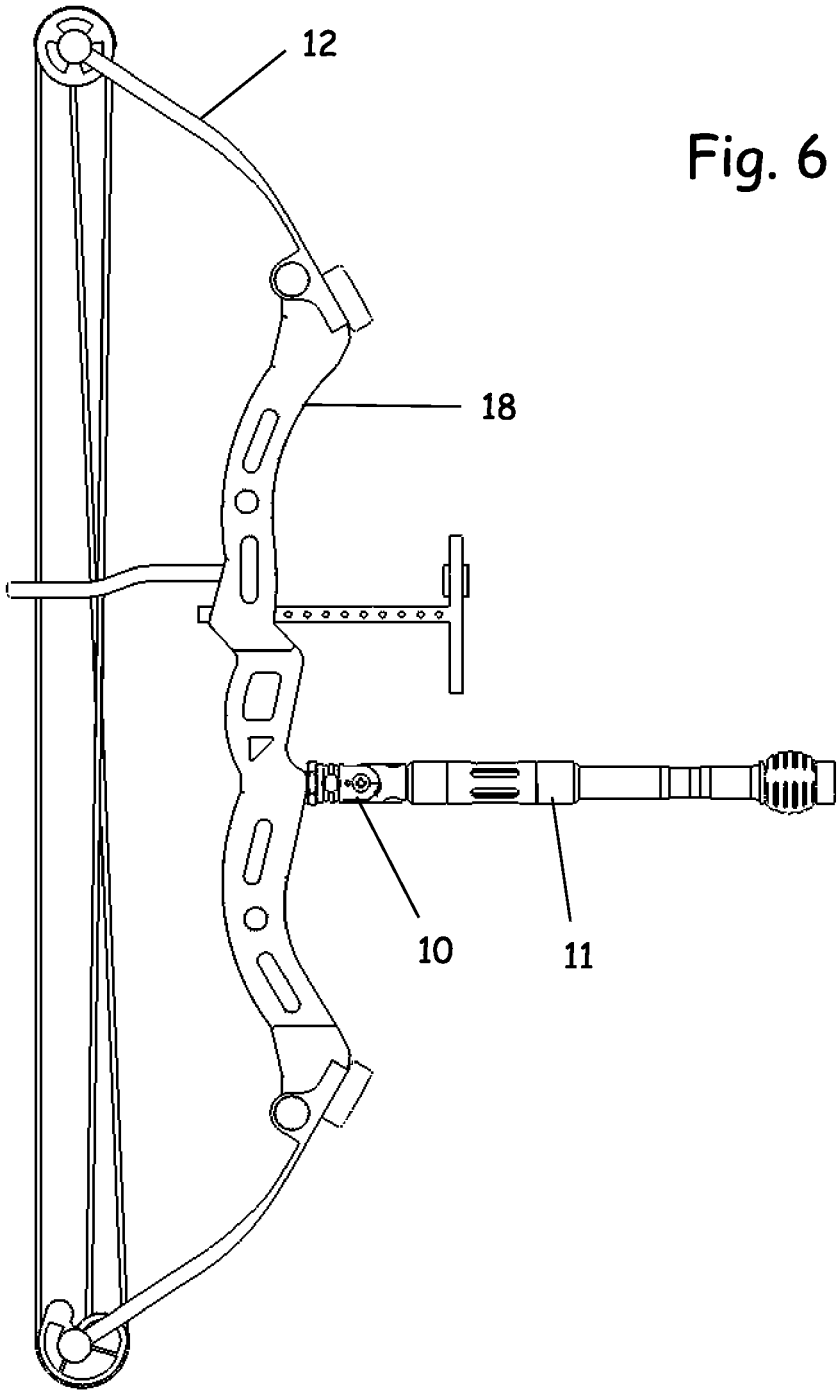
FIG. 6 is a right side elevation view of the archery bow with the stabilizer mounted in a horizontal, straight forward position using the apparatus.
Figure 7:
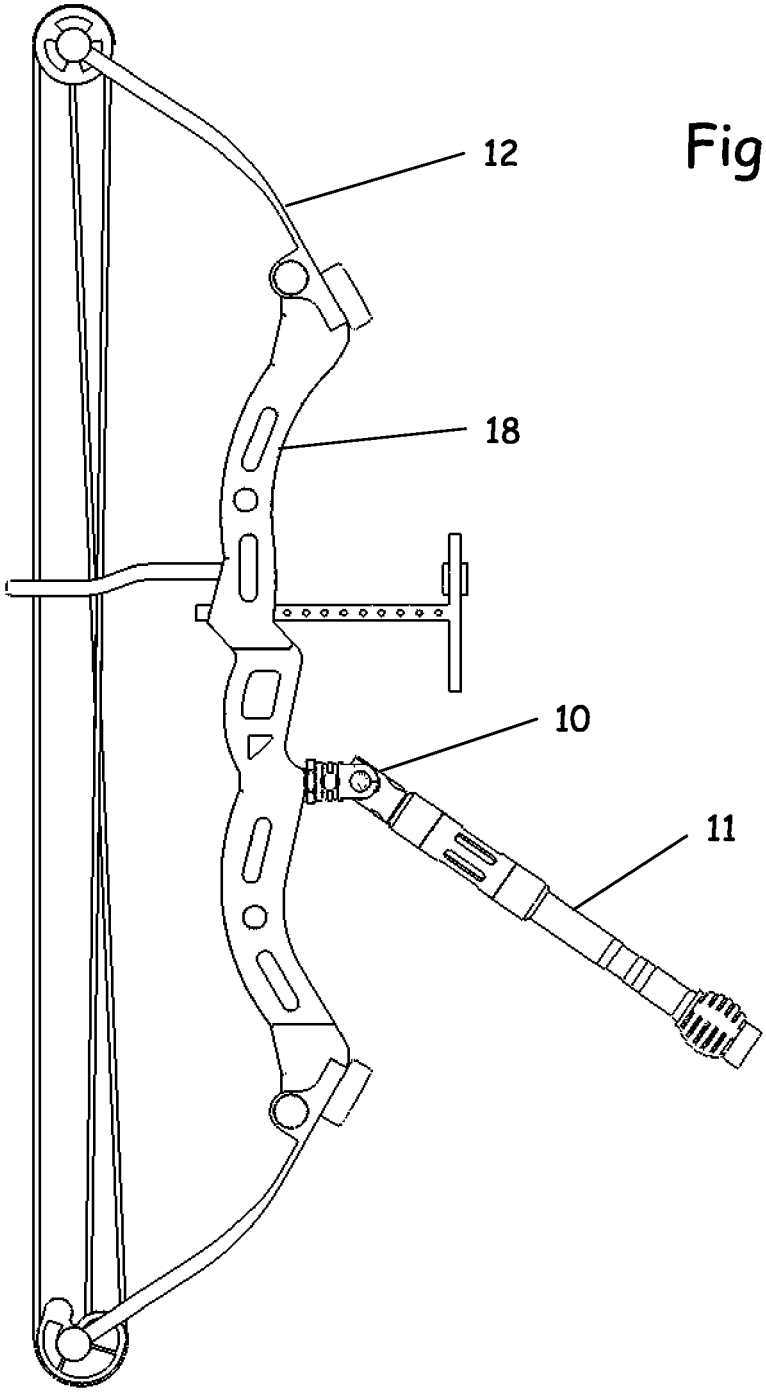
FIG. 7 is a right side elevation view of the archery bow with the stabilizer mounted using the apparatus to extend downwardly and forward from the bow.
Figure 8:
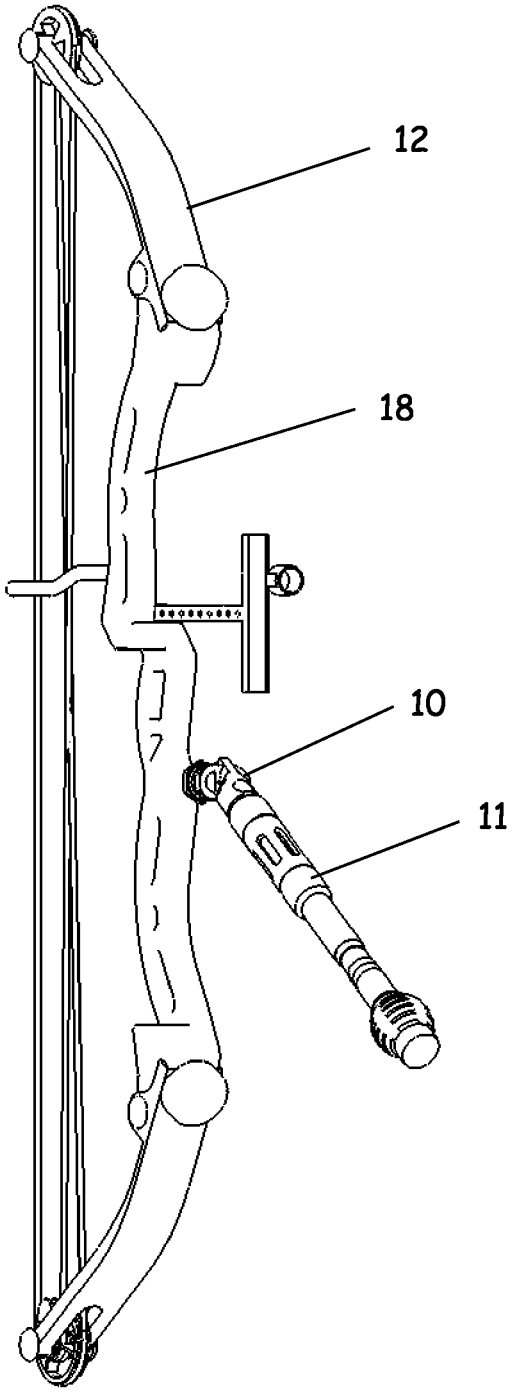
FIG. 8 is a right side elevation view of the archery bow with the stabilizer mounted using the apparatus in the same position shown in FIG. 7.
Figure 9:
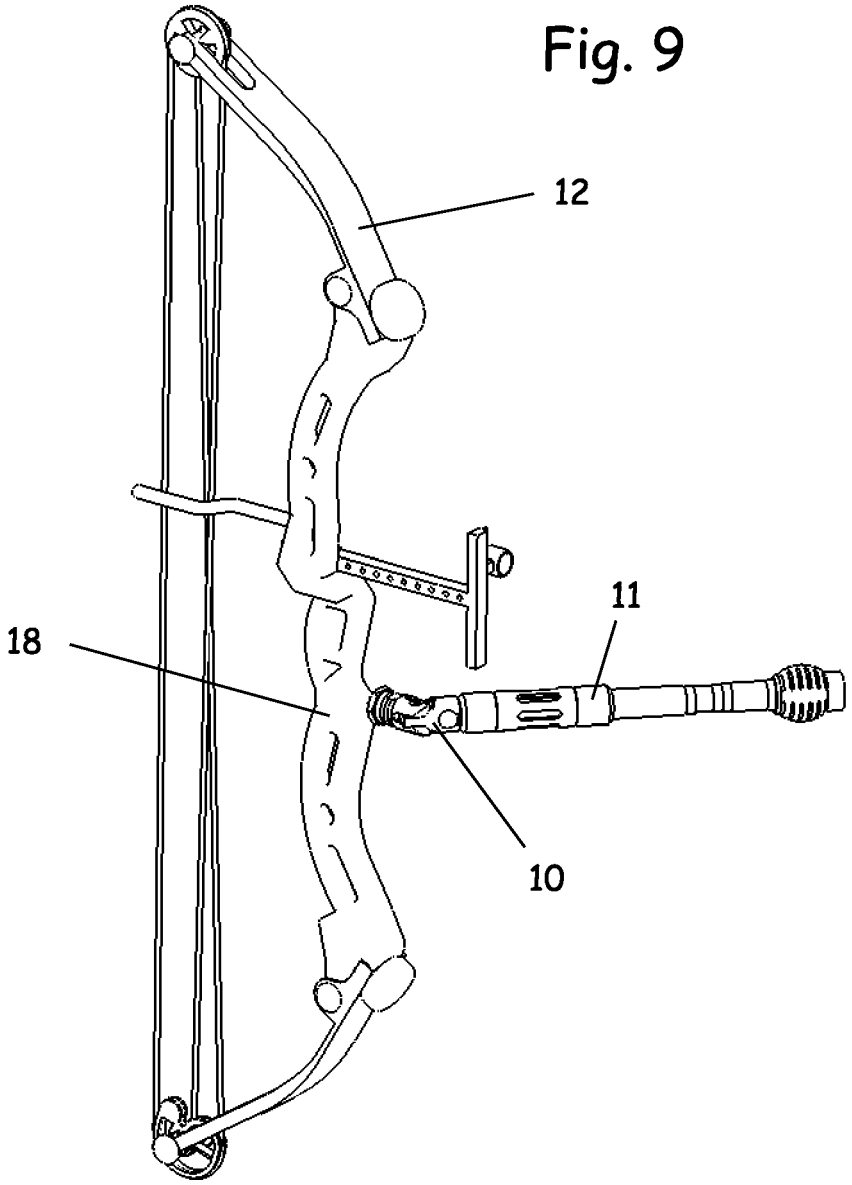
FIG. 9 is a right side elevation view of the archery bow with the stabilizer mounted using the apparatus to extend horizontal and left from the bow.
Figure 10:
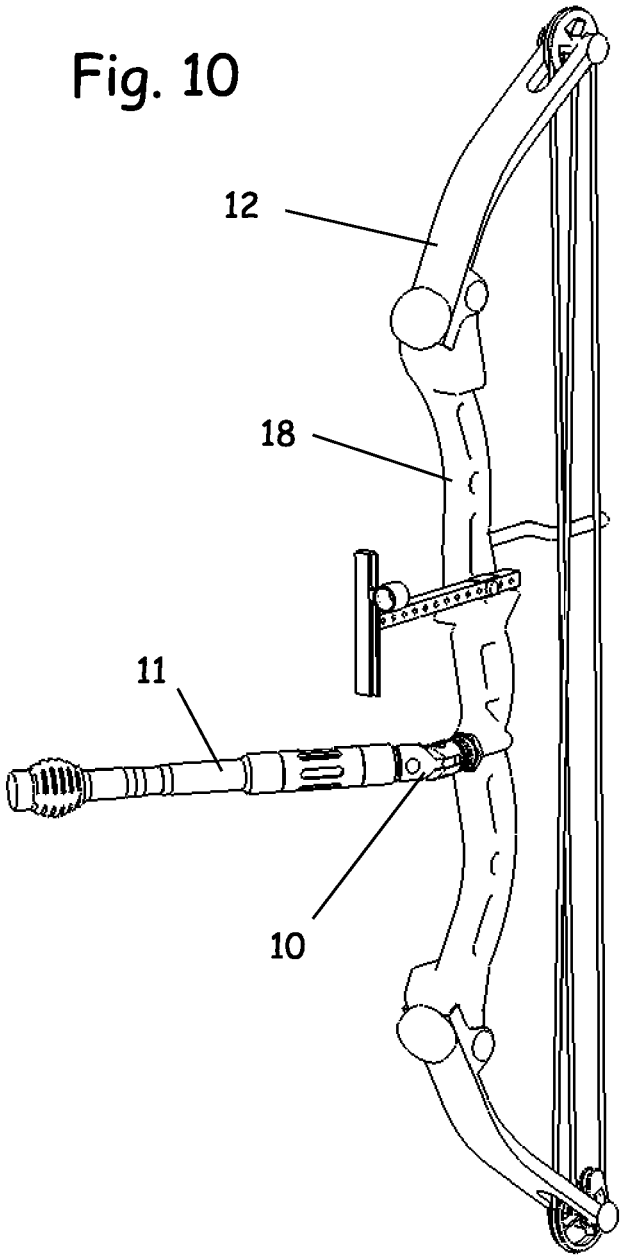
FIG. 10 is a left side elevation view of the archery bow with the stabilizer mounted using the apparatus to extend horizontal and right from the bow.
Figure 11:
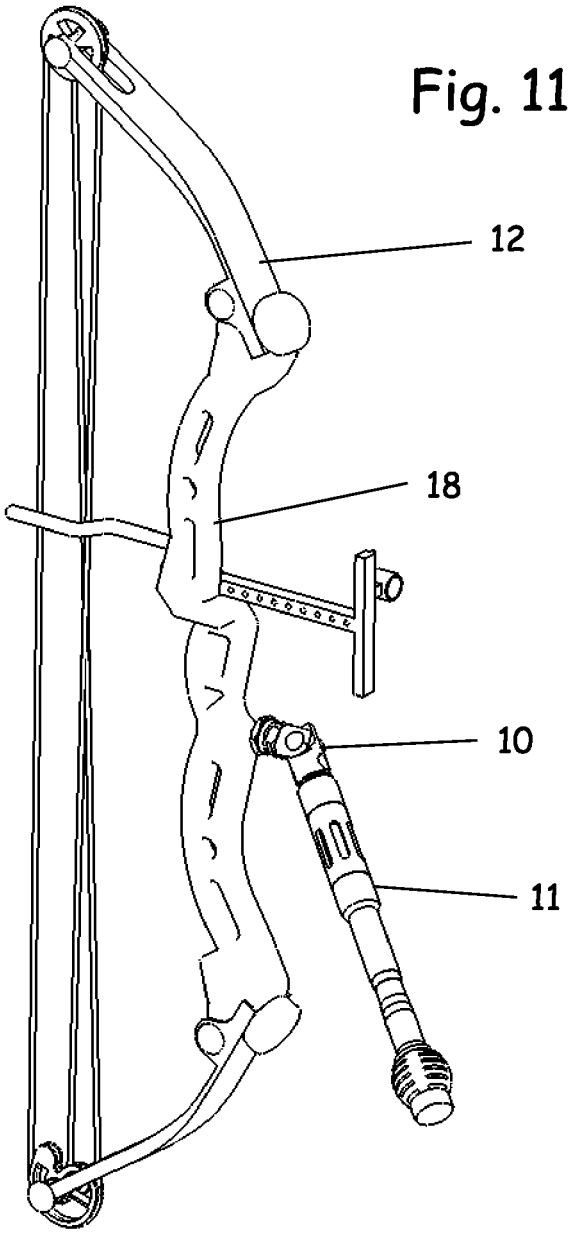
FIG. 11 is a right side elevation view of the archery bow with the stabilizer mounted using the apparatus to extend downward and right from the bow.
Figure 12:
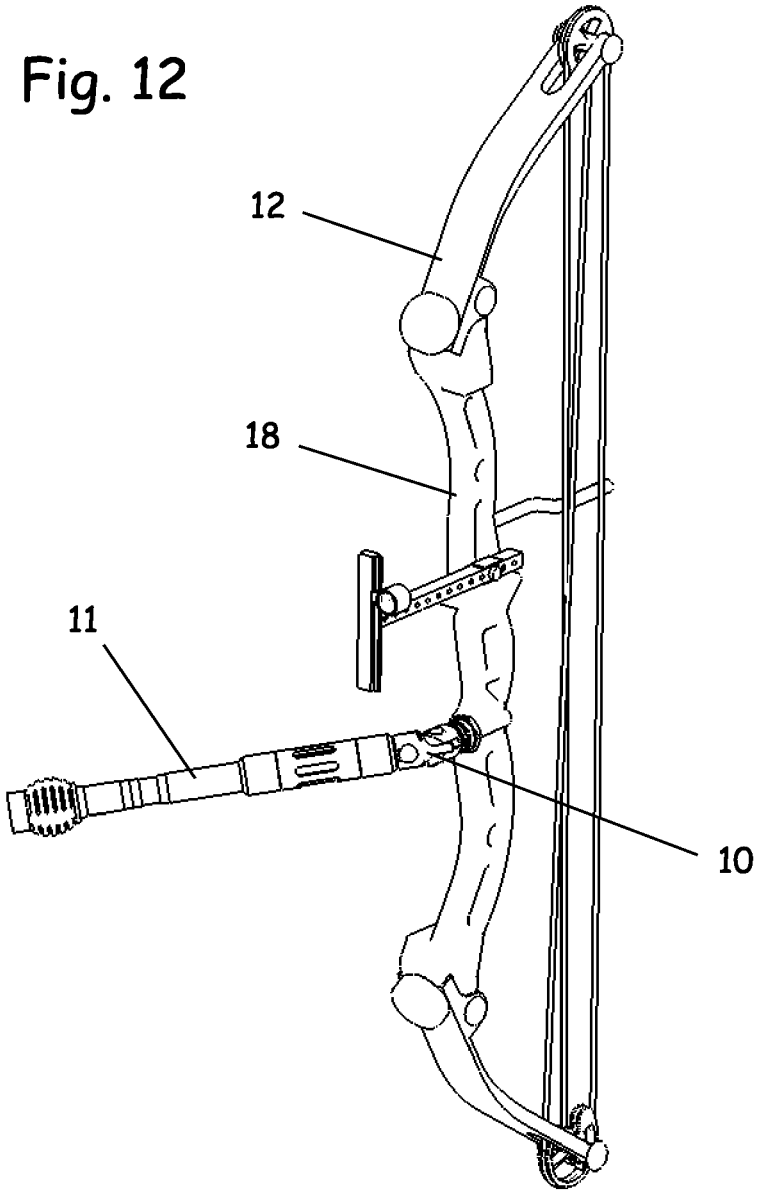
FIG. 12 is a left side elevation view of the archery bow with the stabilizer mounted using the apparatus to extend downward and right from the bow.
Figure 13:
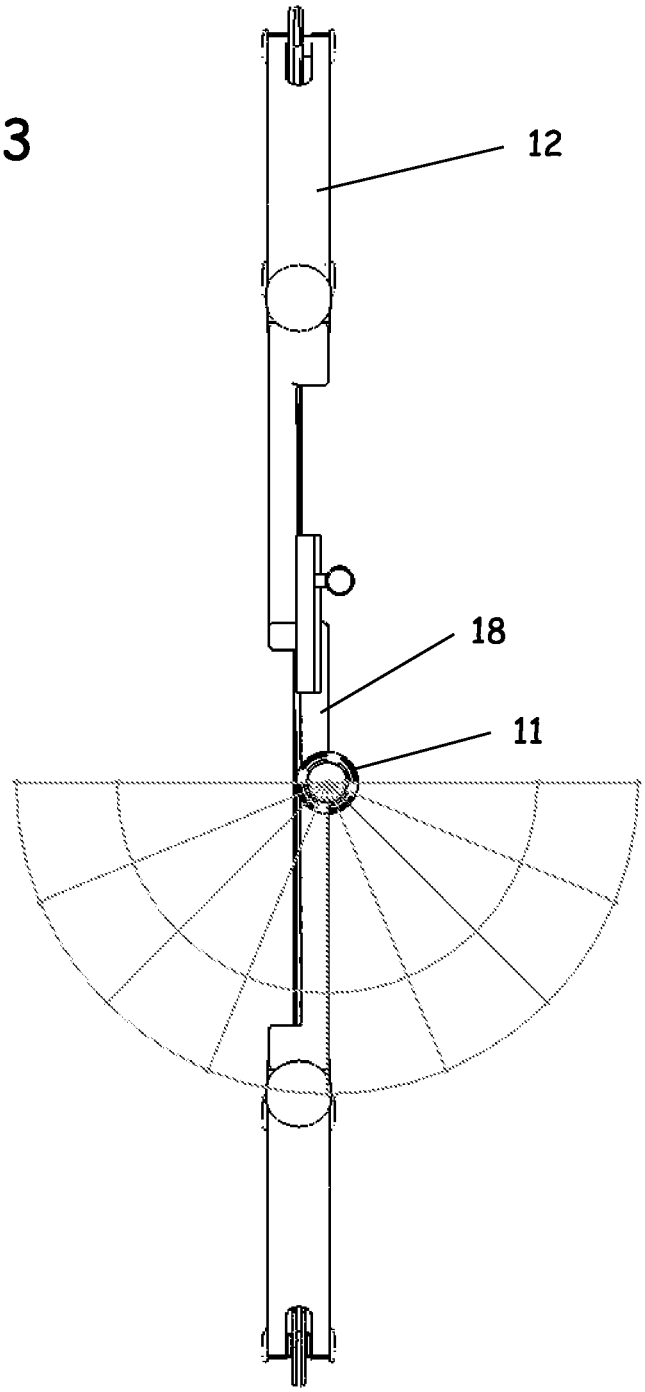
FIG. 13 is a front elevation view of the archery bow with the stabilizer mounted using the apparatus, with phantom lines indicating the various positions of adjustment of the stabilizer.
Figure 14:
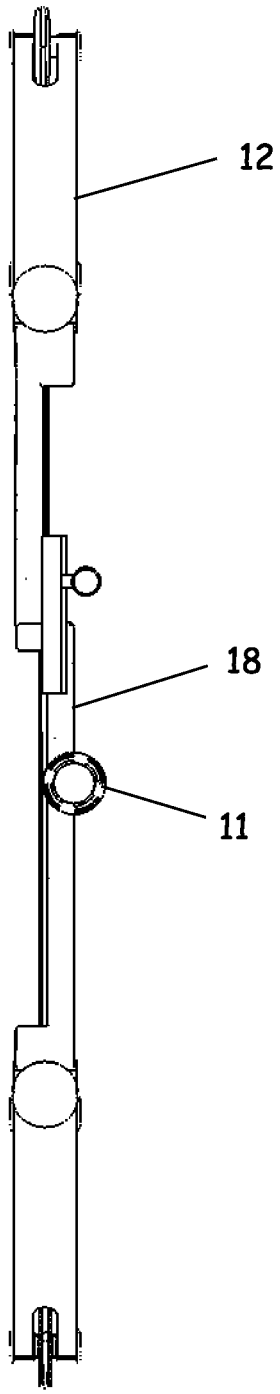
FIG. 14 is a front elevation view of the archery bow with the stabilizer mounted using the apparatus to extend in a horizontal, straight forward position.
Figure 15:
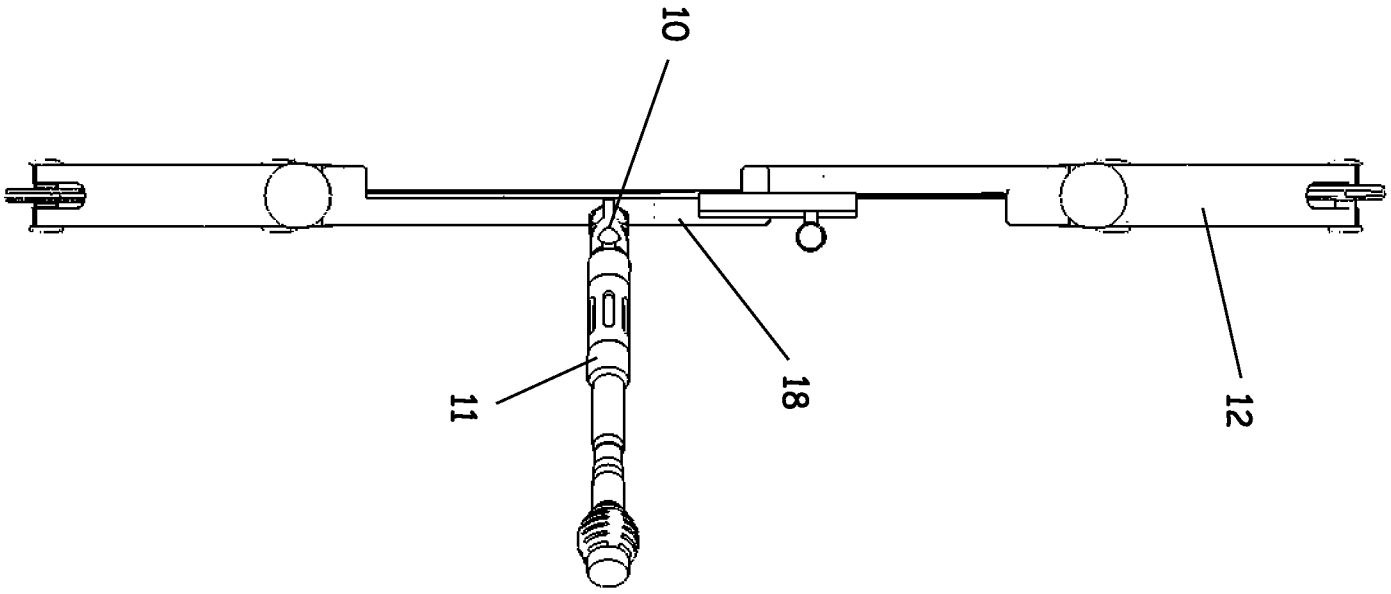
FIG. 15 is a front elevation view of the archery bow with the stabilizer mounted using the apparatus to extend horizontal and left from the bow.
Figure 16:
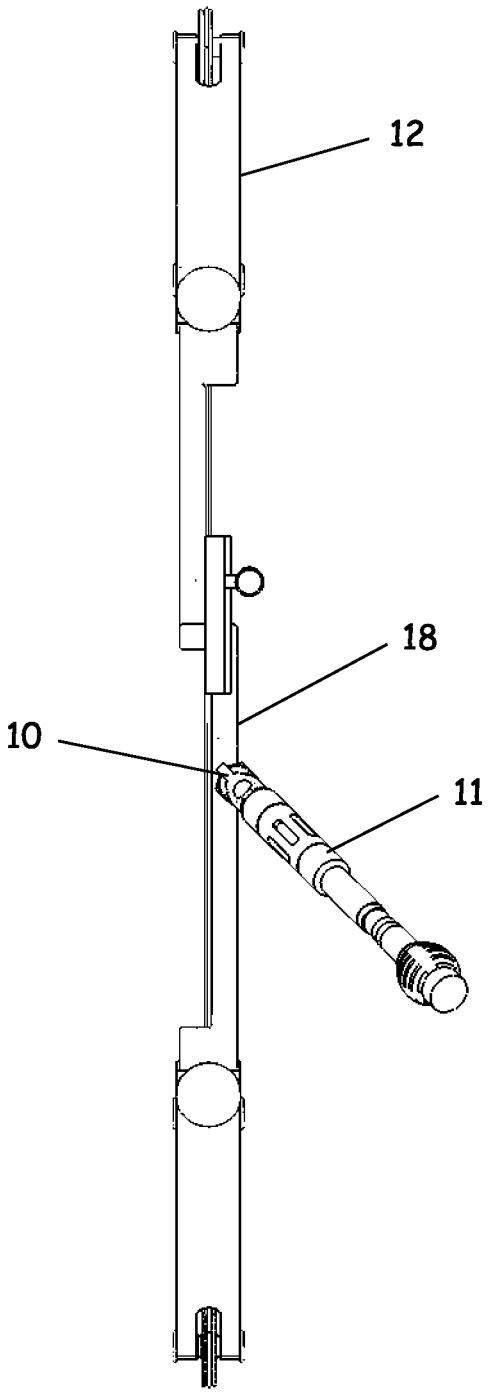
FIG. 16 is a front elevation view of the archery bow with the stabilizer mounted using the apparatus to extend downward and left from the bow.
Figure 17:
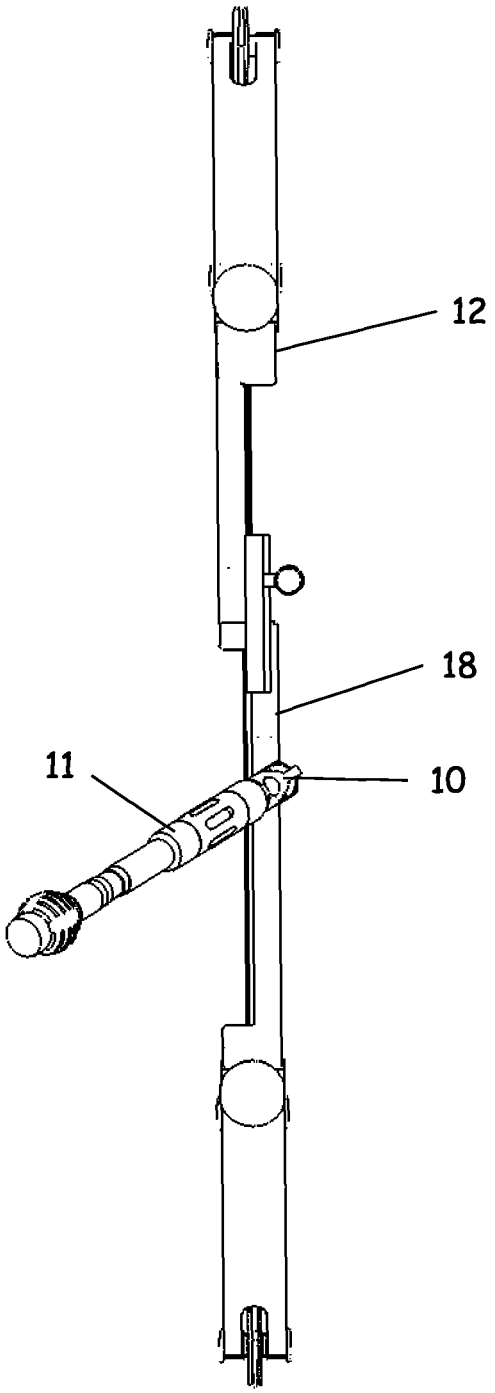
FIG. 17 is a front elevation view of the archery bow with the stabilizer mounted using the apparatus to extend downward and right from the bow.

As shown in FIGS. 4, 5 and 13, the mounting apparatus 10 allows the front mounted stabilizer 11 to be infinitely adjusted to a wide variety of positions, including up and down and side to side. Thus, the forward end of the stabilizer 11 can be positioned in virtually any position desired by the user to accommodate different shooting styles as well as different bow setups. For example, the mounting apparatus 10 can be used to reposition the front stabilizer 11 between a first position desired by the archer when a quiver is mounted on the bow 12 during hunting, and a second position desired by the archer when the quiver is removed during target shooting. This allows the front stabilizer 11 to be positioned right or left and up or down to counterbalance the weight and location of the quiver or other accessories added to or removed from the bow 12.

As shown in FIGS. 18 and 19, the mounting apparatus 10 can also be used to allow a rear mounted stabilizer 11 to be infinitely adjusted to a wide variety of positions, including up and down and side to side.

While the invention has been specifically described in connection with specific embodiments thereof, it is to be understood that this is by way of illustration and not of limitation, and the scope of the appended claims should be construed as broadly as the prior art will permit.

What is claimed is:

1. An apparatus for mounting an accessory to an archery bow, comprising:

a first coupling member having a first longitudinal axis;

a first threaded system for securing the first coupling member to a handle of an archery bow, said first threaded system being arranged to allow said first coupling member to be adjusted about said first longitudinal axis when loosened, and to fix said first coupling member against rotation about said first longitudinal axis when tightened;

a second coupling member having a second longitudinal axis;

a second threaded system for securing said first and second coupling members together, said second threaded system being arranged to allow said first and second coupling members to be adjusted about an axis perpendicular to said first and second longitudinal axes when loosened, and to fix said first and second coupling members together when tightened; and a means for securing an accessory to said second coupling member;

wherein a projection extends from one of said first and second coupling members into a slot formed between two side portions of the other of said first and second coupling members, said second threaded system extends through aligned bores in said projection and said side portions, and said second threaded system is arranged to cause said two side portions to squeeze against said projection to fix said first and second coupling members against rotation relative to each other when tightened;

wherein said second threaded system comprises male and female threaded members inserted into said aligned bores from opposite sides;

wherein said aligned bores in said side portions comprise countersunk bores to allow heads of said threaded members to be at least partially contained within respective outer profiles of the side portions; and further comprising a first rotation preventing structure formed in an outer surface of said female threaded member, and a second rotation preventing structure formed in one of the side portions, said first and second rotation preventing structures cooperating to maintain said female threaded member in a fixed angular position relative to said one side portion.

2. The apparatus according to claim 1, wherein said first threaded system comprises a threaded bolt that mates with a female threaded receptacle in the bow handle, said threaded bolt being rotatable about said first longitudinal axis relative to said first coupling member.

3. The apparatus according to claim 2, wherein said first threaded system further comprises a threaded stud having a longitudinal bore, and wherein said threaded bolt extends through said longitudinal bore to fix said threaded stud to the bow handle.

4. The apparatus according to claim 3, wherein said first coupling member has a female threaded receptacle at one end mated with said threaded stud, and said first threaded system further comprises a jam nut threaded onto said threaded stud, said jam nut being arranged to fix said first coupling member against rotation relative to said threaded stud when tightened.

5. The apparatus according to claim 4, wherein said first coupling member has a pair of diametrically opposed flat portions formed on an external surface thereof for allowing a wrench to be used to hold the first coupling member in a desired position while tightening said jam nut.

6. The apparatus according to claim 1, wherein the head of said female threaded member has a shape that matches the outer profile of the side portion in which the female threaded member is inserted.

7. The apparatus according to claim 1, further comprising a threaded set screw bore formed in at least one of said side portions, and a set screw threaded into said set screw bore, said set screw being arranged to engage against a portion of said projection to lock said coupling members against rotation relative to each other when tightened.

8. The apparatus according to claim 7, wherein said portion of said projection comprises an arcuate groove formed in said projection.

9. The apparatus according to claim 1, further comprising indicia on said first and second coupling members for providing a visual indication of an angle of adjustment between said first and second coupling members.

10. The apparatus according to claim 9, wherein said side members comprise arcuate ends and said projection comprises an arcuate base, and wherein said indicia are provided adjacent to said arcuate ends and said arcuate base.

11. The apparatus according to claim 1, wherein said two side portions are integral with said first coupling member, and said projection is integral with said second coupling member.

12. The apparatus according to claim 1, wherein said aligned bores are perpendicular to said first and second longitudinal axes, respectively.

13. The apparatus according to claim 1, wherein said projection has flat front and rear surfaces that are parallel with each other, and wherein said two side portions forming said slot comprise flat facing surfaces that are parallel with each other and engage said front and rear surfaces of said projection.

14. The apparatus according to claim 1, wherein said means for securing an accessory to said second coupling member comprises a threaded connection.

15. The apparatus according to claim 14, further comprising a quick-disconnect coupling that allows the accessory to be uncoupled from said second coupling member in a direction perpendicular to said second longitudinal axis upon loosening said threaded connection.

16. An adjustable stabilizer assembly for an archery bow, comprising:

a first coupling member having a first longitudinal axis;

a first threaded system for securing the first coupling member to a handle of an archery bow, said first threaded system being arranged to allow said first coupling member to be adjusted about said first longitudinal axis when loosened, and to fix said first coupling member against rotation about said first longitudinal axis when tightened;

a second coupling member having a second longitudinal axis;

a second threaded system for securing said first and second coupling members together, said second threaded system being arranged to allow said first and second coupling members to be adjusted about an axis perpendicular to said first and second longitudinal axes when loosened, and to fix said first and second coupling members together when tightened; and an elongated stabilizer secured to said second coupling member and extending along said second longitudinal axis;

wherein a projection extends from one of said first and second coupling members into a slot formed between two side portions of the other of said first and second coupling members, said second threaded system extends through aligned bores in said projection and said side portions, and said second threaded system is arranged to cause said two side portions to squeeze against said projection to fix said first and second coupling members against rotation relative to each other when tightened;

wherein said second threaded system comprises male and female threaded members inserted into said aligned bores from opposite sides;

wherein said aligned bores in said side portions comprise countersunk bores to allow heads of said threaded members to be at least partially contained within respective outer profiles of the side portions; and further comprising a first rotation preventing structure formed in an outer surface of said female threaded member, and a second rotation preventing structure formed in one of the side portions, said first and second rotation preventing structures cooperating to maintain said female threaded member in a fixed angular position relative to said one side portion.

17. An archery bow, comprising:

a bow handle having a threaded bore in a front side thereof;

an elongated stabilizer for balancing and stabilizing the bow; and an adjustable apparatus for mounting the stabilizer to the front side of the bow and allowing the stabilizer to be angularly adjusted in a side-to-side direction and in an up-and-down direction to a selected position in front of the bow to balance and stabilize the bow, said apparatus comprising:

a first coupling member having a first longitudinal axis;

a first threaded system for securing the first coupling member to the threaded bore in the front side of the handle, said first threaded system being arranged to allow said first coupling member to be adjusted about said first longitudinal axis when loosened, and to fix said first coupling member against rotation about said first longitudinal axis when tightened;

a second coupling member having a second longitudinal axis;

a second threaded system for securing said first and second coupling members together, said second threaded system being arranged to allow said first and second coupling members to be adjusted about an axis perpendicular to said first and second longitudinal axes when loosened, and to fix said first and second coupling members together when tightened; and said elongated stabilizer secured to said second coupling member and extending along said second longitudinal axis;

wherein a projection extends from one of said first and second coupling members into a slot formed between two side portions of the other of said first and second coupling members, said second threaded system extends through aligned bores in said projection and said side portions, and said second threaded system is arranged to cause said two side portions to squeeze against said projection to fix said first and second coupling members against rotation relative to each other when tightened;

wherein said second threaded system comprises male and female threaded members inserted into said aligned bores from opposite sides;

wherein said aligned bores in said side portions comprise countersunk bores to allow heads of said threaded members to be at least partially contained within respective outer profiles of the side portions; and further comprising a first rotation preventing structure formed in an outer surface of said female threaded member, and a second rotation preventing structure formed in one of the side portions, said first and second rotation preventing structures cooperating to maintain said female threaded member in a fixed angular position relative to said one side portion.

* * * * *